US006158316A

United States Patent [19]

Ichikawa et al.

[11] Patent Number: 6,158,316

[45] **Date of Patent: *Dec. 12, 2000**

[54] CONTACT PRESSURE CONTROL METHOD AND DEVICE FOR ROTARY CUTTER

[75] Inventors: Shigeru Ichikawa, Fujinomiya; Yoshiharu Okahashi, Takaishi, both of Japan

[73] Assignees: Maysun Co., Ltd., Shizuoka-ken; Asahi Machinery Ltd., Osaka-fu, both of Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/963,066

[22] Filed: Nov. 3, 1997

[30] Foreign Application Priority Data

Nov. 6, 1996 [JP] Japan ..... 8-293561

[51] Int. Cl.[7] ..... B26D 5/00

[52] U.S. Cl. ..... 83/74; 83/75; 83/345; 83/347; 83/348; 83/503; 83/506

[58] Field of Search ..... 83/74, 75, 305, 83/345, 346, 347, 348, 502, 503, 506, 507

[56] References Cited

U.S. PATENT DOCUMENTS

| | | | |
|---|---|---|---|
| 2,706,524 | 4/1955 | Hall | 83/503 X |
| 3,209,633 | 10/1965 | Doerman | 83/348 X |
| 4,527,473 | 7/1985 | Littleton | 83/101 |
| 4,656,905 | 4/1987 | Ginzburg et al. | 83/305 X |
| 4,667,550 | 5/1987 | Eiting | 83/74 X |
| 4,736,660 | 4/1988 | Benach et al. | 83/347 X |
| 4,984,490 | 1/1991 | Kurki | 83/74 X |
| 5,365,814 | 11/1994 | Irikura | 83/74 |
| 5,421,683 | 6/1995 | Keehn | 83/74 X |
| 5,720,210 | 2/1998 | Okahasi | 83/348 X |

FOREIGN PATENT DOCUMENTS

| | | |
|---|---|---|
| 0016615 | 10/1980 | European Pat. Off. . |
| 0707928 | 4/1996 | European Pat. Off. . |
| 19607836 | 9/1997 | Germany . |
| 6-304895 | 11/1994 | Japan . |
| 91/17027 | 11/1991 | WIPO . |

*Primary Examiner*—M. Rachuba

*Attorney, Agent, or Firm*—Evenson, McKeown, Edwards & Lenahan, P.L.L.C.

[57] ABSTRACT

Pressure working on each support mechanism or on a clearance adjusting mechanism disposed on opposite end portions of a knife rotor and a plain rotor while a sheet material being cut is measured. The clearance adjusting mechanism is actuated to adjust the contact pressure of the knife based on the measured pressure.

2 Claims, 5 Drawing Sheets

CONTACT PRESSURE CONTROL METHOD AND DEVICE FOR ROTARY CUTTER

BACKGROUND OF THE INVENTION

FIELD OF THE INVENTION

The present invention relates to a rotary cutter for cutting consecutively such sheet material as paper strip, paper board, synthetic resin film, etc. into pieces with desired length, in particular, to a contact pressure control method for this kind of rotary cutter and a device therefor.

The sheet product such as paper, film, etc., includes a group of flat product and another group of roll product. The flat product is formed by cutting the product supplied from a sheet manufacturing line or the roll product in the feeding direction and the width direction of the product with a slitter and a fly knife in a cutter or a sheeter.

Regarding the cutting method, a slitter employing the type of thin upper and lower blades produces little paper dust even in cutting the paper of 600 g/m2. But there are some problems in cutting with a fly knife. In the type with one fixed blade shown in FIG. 4 of the attached drawings, for example, a paper sheet 1 is cut by a fixed blade 2 and a rotating blade 3, but this type has not enough power for cutting a thick paper. To cut the thick paper, a twin rotor type with an upper and a lower rotating blades shown in FIG. 5 has been developed and is in main use at present. In this twin rotor type, however, an adjusting operation for matching relative positions of the upper and the lower rotating blades is so difficult that even a skilled worker needs six to eight hours for the blade position matching in some cases.

To solve these problems, a rotary cutter with a structure shown in FIG. 6 has been developed. The details of the structure and the operation of this rotary cutter are disclosed in the Japanese Patent Laid-Open Publication Number 6-304895/1994. Briefly described, the rotary cutter comprises a knife rotor 6, a plain rotor 7, and a feed roller 8. The knife rotor 6 has knives 9*a*, 9*b* which are mounted on the two portions of outer surface of said knife rotor and arranged in the longitudinal direction of the knife rotor. In this rotary cutter, the paper sheet 1 which is sandwiched between and fed from the plain rotor 7 driven by a variable speed motor and the feed roller 8 is cut by the knife 9*a* attached to the outer surface of the knife rotor 6 driven by a servo motor while the paper 1 is pressed against the plain rotor 7. The knife rotor 6 is controlled and driven so as to rotate at the same speed with that of the fed paper 1 only when the attached knives 9*a*, 9*b* contact the paper 1 to be cut.

The structure and operation of this rotary cutter have been described above and a holding mechanism of the respective knives 9*a*, 9*b* in the knife rotor 6 is, for example, as shown in an enlarged partial sectional view of FIG. 7. As shown in FIG. 7, the knife 9*a* is attached to the knife rotor 6 as follows. At first, a knife holder 12 equipped with a permanent magnet 11 is fixed by a bolt 13 into a groove 10 formed in the longitudinal direction of the knife rotor 6, and then, into an insertion groove 14 formed consequently, the knife 9*a* is simply inserted, and, as a result, the knife can be fixed to the knife rotor 6 due to the magnetic effect. Accordingly, the knife replacement service can be carried out within a few seconds and the period for knife replacement has surprisingly been reduced.

But in such material as film where a cut section is expected to be a similar one cut by a guillotine, even a rotary cutter as described above needs the blade position matching, that is, the clearance between the plain rotor 7 and the position of knife rotor 6 in FIG. 6 and FIG. 7 must be adjusted. Traditionally, the clearance is adjusted in a manner that the relative position of the upper and lower blades is adjusted by carefully examining the cut section of a sheet or carefully listening to the sound at the cutting, and therefore, the adjusting operation is still a difficult work.

Furthermore, the contact pressure, even if once adjusted, changes in the long hour running due to the knife wear itself or to the variation in size resulting from the expansion and contraction of the knife and surrounding machine components. It is very difficult to compensate these factors.

The object of the present invention is to provide a contact pressure control method and a device for a rotary cutter which solves the problems of the conventional technology as described above.

SUMMARY OF THE INVENTION

According to one aspect of the present invention, there is provided a contact pressure control method for controlling a contact pressure of a knife mounted on a knife rotor against a plain rotor. The contact pressure control method is applied to a rotary cutter for cutting a sheet material consecutively into pieces with predetermined length.

The knife rotor is equipped with at least one knife on its outer surface in the longitudinal direction of the knife rotor.

The plain rotor is disposed parallel to the knife rotor so that the outer surface of the plain rotor almost comes in contact with a blade edge of the knife on the knife rotor.

A clearance adjusting mechanism is provided for adjusting a clearance between the knife and said plain rotor. The adjusting mechanism is installed in connection with each support mechanism disposed on both end portions of the knife rotor and the plain rotor.

A pressure working on each support mechanism or on the clearance adjusting mechanism while the sheet material being cut is measured and the adjusting mechanism is actuated so that the contact pressure is adjusted based on the measured pressure.

According to a second aspect of the present invention, there is a contact pressure control device for controlling a contact pressure of a knife mounted on a knife rotor against a plain rotor. The contact pressure control device is installed in a rotary cutter for cutting a sheet material consecutively into pieces with predetermined length.

The knife rotor is equipped with at least one knife on its outer surface in the longitudinal direction of the knife rotor;

The plain rotor is disposed parallel to the knife rotor so that the outer surface of the plain rotor almost comes in contact with a blade edge of the knife on the knife rotor.

A clearance adjusting mechanism is provided for adjusting a clearance between the knife and the plain rotor. The adjusting mechanism is installed in connection with each support mechanism disposed on both end portions of the knife rotor and the plain rotor.

A plurality of pressure signal generating means each of which detects a pressure working on said support mechanism or on said clearance adjusting mechanism respectively while said sheet material being cut, generates a pressure signal indicating said pressure;

A pressure signal indicating means indicates the pressure signal transmitted from each pressure signal generating means to an operator.

A control means allows the operator to operate the clearance adjusting mechanism based on a pressure signal indicated by the pressure signal indicating means.

According to a third aspect of the present invention, a contact pressure control device is provided for controlling a contact pressure of a knife mounted on a knife rotor against a plain rotor. The contact pressure control device is installed in a rotary cutter for cutting a sheet material consecutively into pieces with predetermined length.

The knife rotor is equipped with at least one knife on its outer surface in the longitudinal direction of the knife rotor.

The plain rotor is disposed parallel to the knife rotor so that for the outer surface of said plain rotor almost comes in contact with a blade edge of the knife on the knife rotor.

A clearance adjusting mechanism is provided for adjusting a clearance between the knife and the plain rotor. The adjusting mechanism is installed in connection with each support mechanism disposed on both end portions of the knife rotor and the plain rotor.

A plurality of pressure signal generating means, each of which detects a pressure working on the support mechanism or on the clearance adjusting mechanism respectively while said sheet material being cut, generates a pressure signal indicating said pressure.

An adjusting means is provided for adjusting the contact pressure by actuating the clearance adjusting mechanism in response to the pressure signal transmitted from each pressure signal generating means.

According to one embodiment of the present invention, the pressure signal generating means is a pressure sensor which detects a pressure working on each support mechanism.

According to another embodiment of the present invention, the pressure signal generating means is a pressure sensor which detects a pressure working on the clearance adjusting mechanism.

BRIEF DESCRIPTION OF THE DRAWINGS

The present invention and its preferred embodiments will be described in greater detail with reference to the accompanying drawings, in which.

DESCRIPTION OF THE PREFERRED EMBODIMENTS

Figure 1:
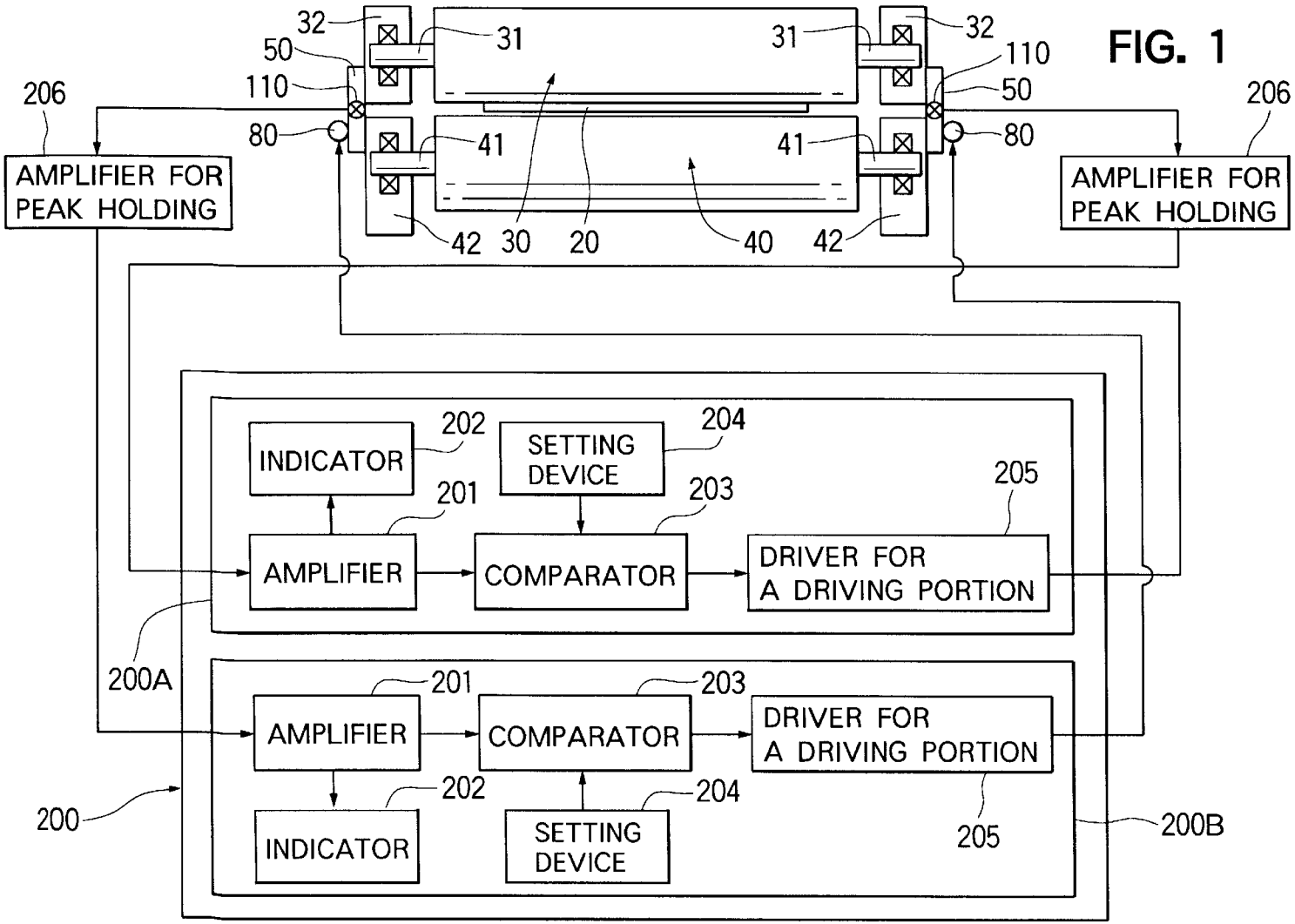
FIG. 1 is a schematic view illustrating a diagrammatic constitution of a rotary cutter equipped with a contact pressure control device of an embodiment of the present invention.

FIG. 1 is a schematic view illustrating a diagrammatic constitution of a rotary cutter equipped with a contact pressure control device of an embodiment of the present invention. As shown in FIG. 1, the rotary cutter of the embodiment comprises a knife rotor 30 equipped with at least one knife 20 on its outer surface in the longitudinal direction and a plain rotor 40 disposed parallel to said knife rotor 30 so as for the outer surface of said plain rotor 40 to almost come in contact with a blade edge of said knife 20 on said knife rotor 30.

Figure 2:
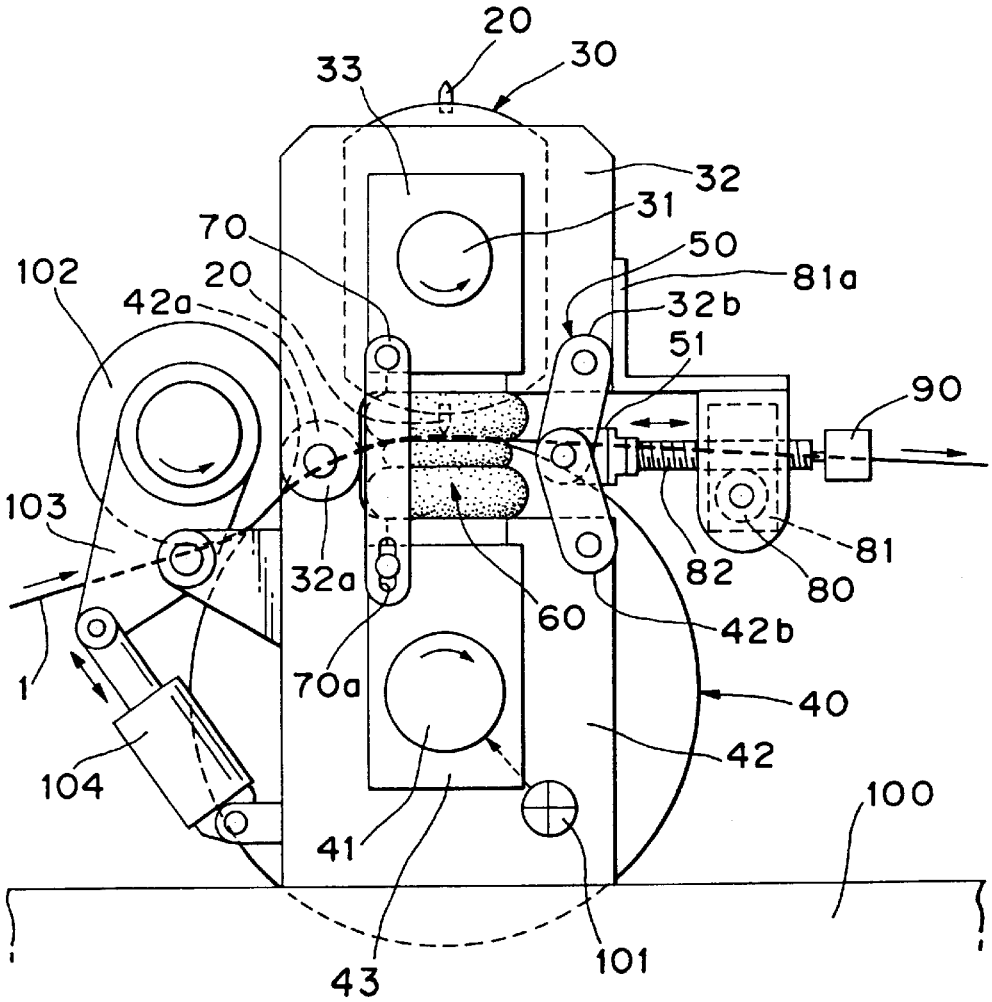
FIG. 2 is a side elevation view illustrating a detailed structure of a bearing box support mechanism and a clearance adjusting mechanism of a knife rotor and a plain rotor of the rotary cutter show in FIG. 1.

FIG. 2 is a side elevation view illustrating a detailed structure of a bearing box support mechanism and a clearance adjusting mechanism of a knife rotor 30 and a plain rotor 40 of the rotary cutter shown in FIG. 1. As for the bearing box support mechanism and the clearance adjusting mechanism, similar structures are employed in either side of the knife rotor 30 and the plain rotor 40 respectively, and, therefore, the explanation will be developed hereinafter only for that disposed in one side. Referring to the bearing box support mechanism , as shown in FIG. 2, an end portion 42*a* of a plain rotor bearing box 42 to support rotatably an end portion of a rotary shaft 41 of the plain rotor 40 supports rotatably an end portion 32*a* of a knife rotor bearing box 32 to support rotatably an end portion of a rotary shaft 31 of the knife rotor 30, and another end portion 42*b* of the plain rotor bearing box 42 supports another end portion 32*b* of the knife rotor bearing box 32 through a toggle mechanism 50. In addition, on an extended end portion of the rotary shaft 41 of the plain rotor 40 is mounted rotatably a support member 43 on the outer side of the plain rotor bearing box 42, and also on an extended end portion of the rotary shaft 31 of the knife rotor 30 is mounted rotatably a support member 33 on the outer side of the knife rotor bearing box 32. Between these two support members 43 and 33 is installed an air spring 60. A connecting plate 70 is attached to prevent the support member 43 and the support member 33 from being pressed and slanted with each other when the air spring is expanded. The connecting plate 70 is fixed by bolt at its upper portion and is supported slidable by a sliding guide groove 70*a* at its lower portion. Therefore, the support member 43 and the support member 33 move parallel with each other.

In this embodiment, a bearing box pre-loading mechanism is composed of the support member 43, the support member 33 and the air spring 60, and, in some cases, the air spring 60 may be replaced by an air cylinder, a hydraulic cylinder or a coil spring, and the bearing box pre-loading mechanism may be connected directly to the knife rotor 30 and the plain rotor 40. The bearing box pre-loading mechanism gives a pressure onto the end portions of the rotary shaft 31 of the knife rotor 30 and the rotary shaft 41 of the plain rotor 40 so that the knife rotor bearing box 32 and the plain rotor bearing box 42 move into the opposite directions with each other. However, two bearing boxes 32 and 42 are held at their positions by the bearing box support mechanism, and, as a result, the knife rotor 30 is deformed downward and the plain rotor 40 is deformed upward. When the knife rotor 30 cuts a paper sheet 1, its center portion is deformed upward resulting in a possible failure of miss-cutting, but said deformation mentioned above gives a downward force to the center portion of the knife to prevent the failure of miss-cutting of the paper sheet 1. To add to that, the downward deformation of the plain rotor 40 caused by its dead weight can be compensated by its upward deformation mentioned above.

Then, referring to the clearance adjusting mechanism, in this embodiment, the clearance adjusting mechanism is composed of the toggle mechanism 50 which is used also as a member of the bearing box support mechanism, a motor 80, a gear box 81 which has high reduction gear ratio and is driven by said rotor 80, and a threaded member 82 with a micro-pitch thread which is driven by said gear box 81. The gear box 81 is fixed to the knife rotor bearing box 32 by a proper channel member 81*a*. In this clearance adjusting mechanism, a toggle joint fitting 51 is moved by rotating the threaded member 82 engaged with the toggle mechanism 50 and the distance between the end portion 42*b* of the plain rotor bearing box 42 and the end portion 32*b* of the knife rotor bearing box 32 is changed. That is, when the clearance between the plain rotor 40 and the knife 20 is made narrower, the threaded member 82 is screwed-in to push the toggle joint fitting 51 forward, and the knife rotor bearing box 32 and the knife rotor 30 are moved downward to make the clearance narrower. When the clearance is made wider, the threaded member 82 is screwed-out to move the toggle joint fitting 51 backward and the knife rotor 30 is moved upward.

As an expanding pressure in the air spring 60 of the bearing box pre-loading mechanism operates so as for the rotary shaft 31 of the knife rotor 30 and the rotary shaft 41 of the plain rotor 40 to move in the opposite directions with each other, the toggle joint fitting 51 of the toggle mechanism 50 always pushes the threaded member 82, so that it is not necessary to connect the toggle joint fitting 51 and the threaded member 82 with each other. As a result, the gear box 81 can be installed independently from the toggle mechanism 50. Furthermore, the travel of the threaded member 82 can be measured accurately by a rotary encoder 90 which is installed on the end portion of the threaded member 82. For example, the clearance between the knife 20 and the plain rotor 40 can be adjusted in microns within the range of −0.5 to +1.5 mm with a reference point where the knife 20 comes into contact with the plain rotor 40.

As shown in FIG. 2, in the rotary cutter of this embodiment, each plain rotor bearing box 42 is fixed on a frame 100 and to the plain rotor bearing box 42 is connected a rotary encoder 101, so that the number of revolution can be measured continuously by said rotary encoder 101. Furthermore, a feed roller 102 is supported rotatably by a bearing box 103 and another end portion of said bearing box 103 is pressed by an expansion force of an air cylinder 104 an end of which is supported rotatably by the plain rotor bearing box 42, so that said feed roller 102 is brought into contact with the outer surface of the plain rotor 40 with a certain loading. The feed roller 102 rotates as the plain rotor 40 does and the outer surface of the feed roller 102 is covered by a soft material to prevent it from slipping.

Detailed structure and operation of the bearing box support mechanism and the clearance adjusting mechanism of the knife rotor 30 and the plain rotor 40 of the rotary cutter has been described, and the paper sheet 1 sandwiched between and fed from the plain rotor 40 and the feed roller 102 is introduced between the plain rotor 40 and a corresponding knife 20 of the knife rotor 30 to be cut. A load applied to the knife 20 at that time is transmitted to the threaded member 82 through the toggle mechanism 50 disposed on both sides. Therefore, the load applied to the knife 20 can be measured indirectly by the output of a pressure sensor 110 interposed between the toggle mechanism 50 and the threaded member 82 as shown in an enlarged schematic view of FIG. 3.

Figure 3:
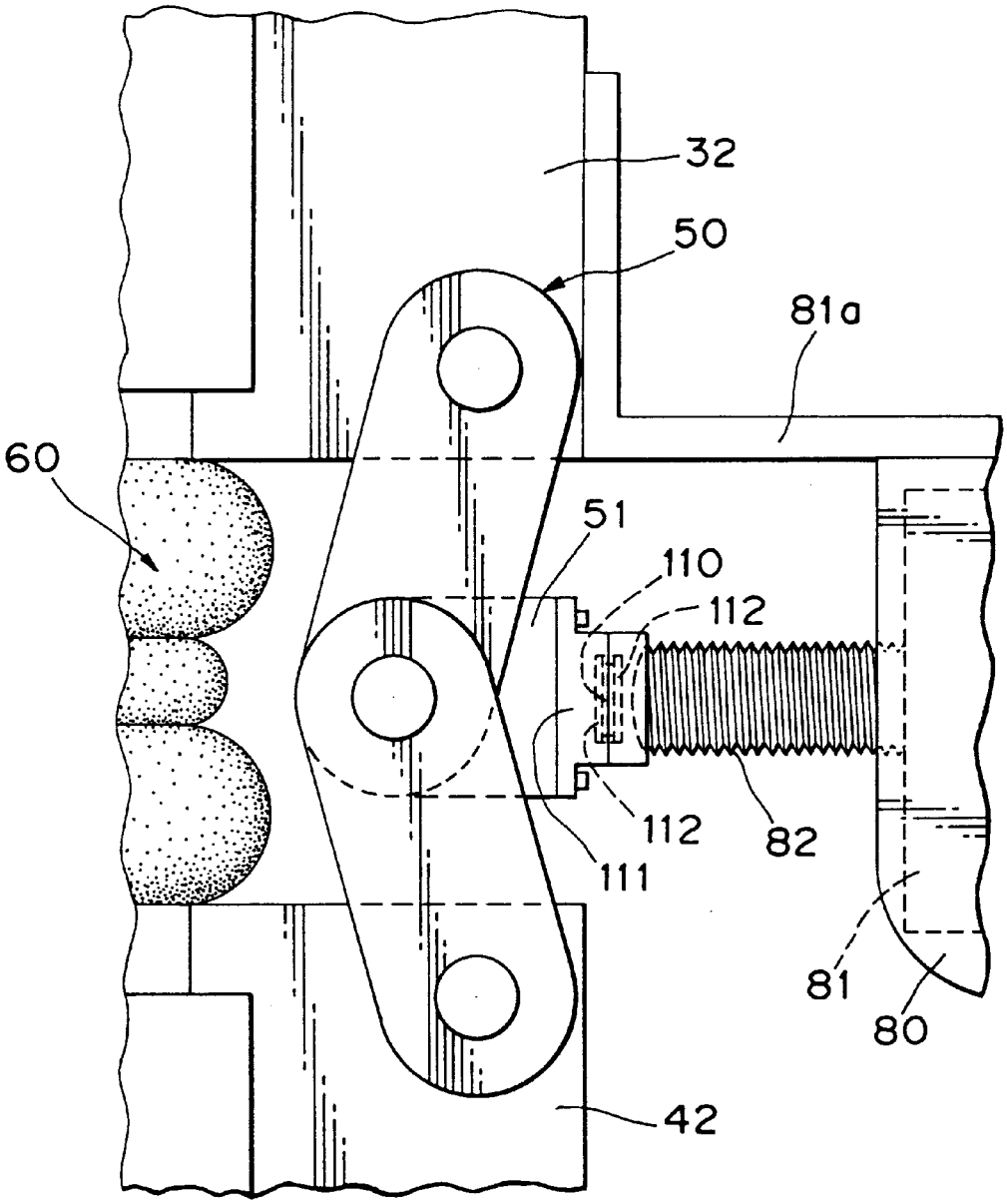
FIG. 3 is an enlarged schematic view illustrating a pressure sensor interposed between the toggle mechanism and the threaded member of the clearance adjusting mechanism of FIG. 2.
Figure 4:
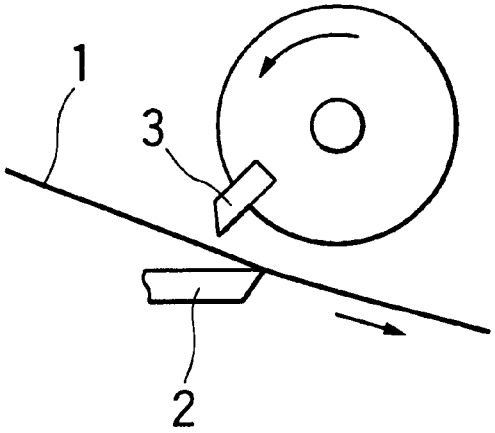
FIG. 4 PRIOR ART
FIG. 4 is a schematic diagram for use in explaining how a conventional rotary cutter with one fixed blade is operated.
Figure 5:
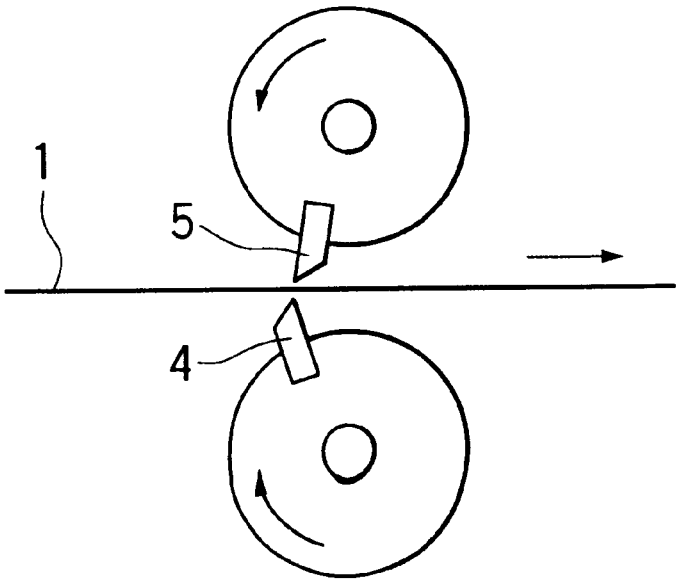
FIG. 5 PRIOR ART
FIG. 5 is a schematic diagram for use in explaining how a conventional twin rotor type rotary cutter is operated.
Figure 6:
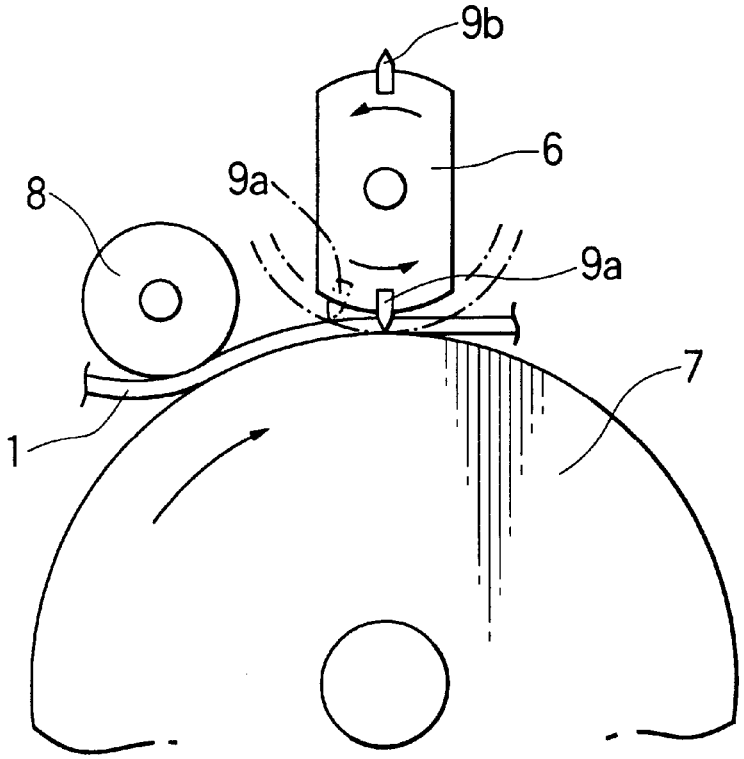
FIG. 6 PRIOR ART
FIG. 6 is a schematic diagram for use in explaining how a conventional rotary cutter with a knife rotor and a plain rotor is operated.
Figure 7:
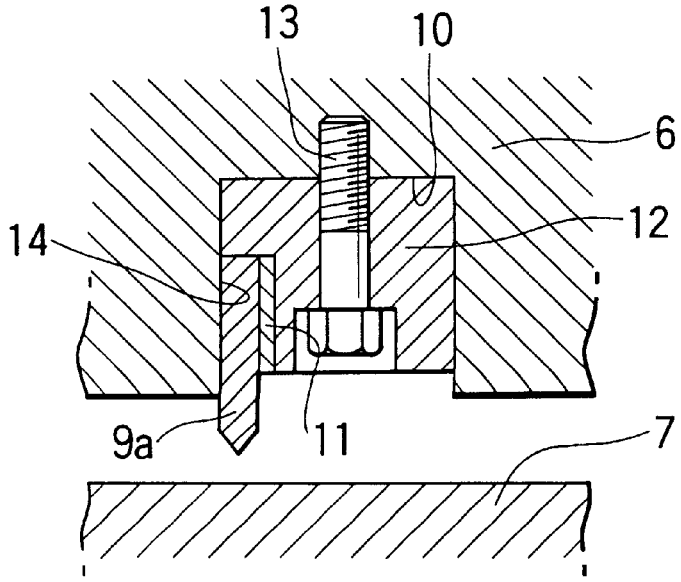
FIG. 7 PRIOR ART
FIG. 7 is an enlarged sectional view of a structure for mounting a knife in the rotary cutter of FIG. 6.

Thought being not shown in FIG. 2 for its simplicity, in this embodiment, the pressure sensor 110 is attached between the toggle joint fitting 51 and the threaded member 82 by a sensor case 111 as shown in FIG. 3. The pressure sensor 110 may be an appropriate piezoelectric element and is kept isolated from the sensor case 111 by a pair of electrode insulators 112.

Again, referring to FIG. 1 for describing whole structure of the contact pressure control device of this embodiment of the present invention, the contact pressure control device of this embodiment is equipped with said pressure sensor 110 attached to the rotary cutter and a circuit 200 for adjusting a contact pressure automatically (hereafter, referred to as contact pressure adjusting circuit) which is connected to the clearance adjusting circuit. The contact pressure adjusting circuit 200 comprises a circuit 200A for controlling an operation of a clearance adjusting mechanism installed on the right end portion of the rotary cutter and a circuit 200B for controlling an operation of another clearance adjusting mechanism installed on the left end portion of the rotary cutter. Each of these circuits, 200A and 200B, may have similar construction with each other, and, in this embodiment, comprises an amplifier 201, an indicator 202, a comparator 203, a setting device 204, a driver for a driving portion 205 (hereafter referred to as the driver), and an amplifier for peak holding 206 (hereafter referred to as the peak holding amplifier).

Now will be described an actuation of the contact pressure adjusting circuit 200. The peak holding amplifier 206 of the circuit 200A holds a peak value of the pressure signal which is detected by the pressure sensor 110 disposed in the clearance adjusting mechanism of the right end portion of FIG. 1 while the paper sheet 1 being cut by the knife 20 and transmits it to the amplifier 201. The amplifier 201 receives and amplifies said instantaneous peak value of the pressure signal and indicates it on the indicator 202 and transmits it to the comparator 203. The comparator 203 compares the pressure signal transmitted from the amplifier 201 with a set value of the contact pressure set by the setting device 204. When the pressure signal transmitted from the amplifier 201 is higher than the set value of the contact pressure (desired value), the motor 80 of the clearance adjusting mechanism of the right end portion is actuated through the driver 205 so that the threaded member 82 is moved backward and the clearance between the knife 20 and plain rotor 40 is made wider automatically. When the pressure signal transmitted from the amplifier 201 is lower than the set value of the contact pressure (desired value), the motor 80 of the clearance adjusting mechanism of the right end portion is rotated in the reverse direction through the driver 205 so that the threaded member 82 is moved forward and the clearance between the knife 20 and plain rotor 40 is made narrower automatically.

The circuit 200B for the clearance adjusting mechanism of the left end portion actuates the clearance adjusting mechanism of the left end portion in the same automatic adjusting manner as the circuit 200A does for the clearance adjusting mechanism of the right end portion as described above. Thus, the contact pressure control device of this embodiment allows a contact pressure values of the knife 20 and the plain rotor 40 to be automatically and easily adjusted to the desired value by detecting the applied load values, namely instantaneous pressure value, to the right end portion and the left end portion of the knife rotor 30 and the plain rotor 40 while the paper sheet being cut by the knife 20, by comparing them with the desired pressure value, and then by actuating each of the clearance adjusting mechanisms disposed in the right end portion and the left end portion respectively in response to each result of comparison.

Though the contact pressure adjusting circuit 200 of the above embodiment is composed only of a plurality of hardware units, these kinds of circuit to adjust a contact pressure automatically can be also made up of a sequencer, a micro-computer system, a personal computer and so forth. In addition, though the above embodiment employs a peak pressure value applied to the pressure sensor 110 as a representative value of the contact pressure by the use of the peak holding amplifier 206, the present invention is not restricted to the details of this description. For example, the whole output signal from the pressure sensor 110 may be used by sampling the values in several points without limitation on whether it being the peak value or not and taking an average thereof as the pressure value by the use of an appropriate sampling holding circuit as a substitute for the peak holding amplifier 206. To add to that, though, in the above embodiment, the pressure sensor 110 detects the load applied to the threaded member 82 through the toggle mechanism 50, the present invention is not restricted to that system but allows similar pressure sensor to be disposed on the relative portion of the bearing box support mechanism, for example, on the portion where the load can be detected which is applied to the bearing box 42, to the end portion 42*a* of the plain rotor bearing box 42, or to the end portion 32*a* of the knife rotor 32. Furthermore, though the piezoelectric element made of ceramics and the like is used as the pressure sensor 110, any kind of detecting element may be used also, so far as it can detect the load applied to the portion mentioned above.

In addition, the above embodiment makes it possible to adjust the contact pressure full-automatically by providing the contact pressure adjusting circuit 200, but the present invention is not limited to this system. For example, the personal computer and the like may be used in place of the contact pressure adjusting circuit 200. In this system, the values of the load applied to the bearing box support mechanism or the clearance adjusting mechanism of the right end portion and the left end portion while the paper sheet being cut by the knife are transmitted to the personal computer through the peak holding amplifier 206. Then, these load values are indicated on the CRT of the personal computer. The operator may determine the correcting values from the load values indicated on the CRT and input them from the keyboard of the personal computer. In response to the input correcting values, the motor 80 of the corresponding portion of the clearance adjusting mechanism is actuated to control the feed amount of the toggle mechanism 50 by the thread on the threaded member 82, so that the contact pressure can be easily adjusted to the desired value.

The contact pressure adjustment of the knife of rotary cutter can be accomplished easily and quickly with numerical controlling without traditional sensory controlling. Even if the rotary cutter is driven for long time, the change in contact pressure which may be caused by the wear of knife itself and the variation in size resulting from the expansion and contraction of the surrounding mechanical components can be compensated easily and quickly.

What is claimed is:

1. A contact pressure control device for controlling a contact pressure of a knife mounted on a knife rotor against a plain rotor, said contact pressure control device being installed in a rotary cutter for cutting a sheet material consecutively into pieces with predetermined length, said knife rotor equipped with at least one knife on its outer surface in the longitudinal direction of said knife rotor, and said plain rotor disposed parallel to said knife rotor so that the outer surface of said plain rotor almost comes in contact with a blade edge of said knife on said knife rotor, said rotary cutter comprising: a clearance adjusting mechanism for adjusting a clearance between said knife and said plain rotor, said adjusting mechanism being installed in connection with support mechanisms disposed on both end portions of said knife rotor and said plain rotor, respectively, with no mechanical connection of said clearance adjusting mechanism and said support mechanisms between both end portions of the knife rotor and the plain rotor, said clearance adjusting mechanism comprising a toggle mechanism and pushing means for acting on said toggle mechanism to change an amount by which said toggle mechanism is pushed to adjust the clearance between said knife and said plain rotor, said contact pressure control device comprising:

pressure signal generating means interposed between said toggle mechanism and said pushing means for detecting a pressure working on said clearance adjusting mechanism respectively while said sheet material is being cut and generating a pressure signal indicating said pressure;

a pressure signal indicating means for indicating the pressure signal transmitted from each pressure signal generating means to an operator; and an operating means to allow the operator to operate said pushing means based on a pressure signal indicated by said pressure signal indicating means.

2. A contact pressure control device as claimed in claim 1, in which said pressure signal generating means is a pressure sensor which detects a pressure working between said toggle mechanism and said pushing means.

* * * * *